US009863101B2

(12) United States Patent
Mollick et al.

(10) Patent No.: US 9,863,101 B2
(45) Date of Patent: Jan. 9, 2018

(54) HIGHLY PORTABLE ASPHALT PLANT

(71) Applicant: Gencor Industries, Inc., Orlando, FL (US)

(72) Inventors: Joseph T Mollick, Longwood, FL (US); Willam D. Gulley, Orlando, FL (US); Thomas F Gebhard, Orlando, FL (US)

( * ) Notice: Subject to any disclaimer, the term of this patent is extended or adjusted under 35 U.S.C. 154(b) by 85 days.

(21) Appl. No.: 15/172,232

(22) Filed: Jun. 3, 2016

(65) Prior Publication Data

US 2016/0355998 A1 Dec. 8, 2016

Related U.S. Application Data

(60) Provisional application No. 62/170,786, filed on Jun. 4, 2015.

(51) Int. Cl.

| | |
|---|---|
| ***E01C 19/10*** | (2006.01) |
| ***E01C 19/02*** | (2006.01) |
| ***E01C 19/05*** | (2006.01) |

(52) U.S. Cl.

CPC ..... *E01C 19/10* (2013.01); *E01C 19/02* (2013.01); *E01C 19/05* (2013.01); *E01C 19/1027* (2013.01)

(58) Field of Classification Search

CPC ..... E01C 19/10; E01C 19/02; E01C 19/05
USPC ..... 366/22
See application file for complete search history.

(56) References Cited

U.S. PATENT DOCUMENTS

| | | | | |
|---|---|---|---|---|
| 5,219,450 | A | 6/1993 | Thurk | |
| 5,397,177 | A | 3/1995 | Swisher, Jr. | |
| 6,695,530 | B2 * | 2/2004 | Crupi | E01C 23/065 404/75 |
| 6,769,836 | B2 * | 8/2004 | Lloyd | E01C 23/065 404/75 |
| 7,384,181 | B1 * | 6/2008 | Collette | E01C 19/1004 366/147 |
| 7,572,081 | B2 * | 8/2009 | Buschmann | E01C 19/17 404/101 |
| 2003/0142579 | A1 * | 7/2003 | Throop | B28C 7/06 366/3 |
| 2013/0343145 | A1 * | 12/2013 | Villalobos Davila | C04B 18/167 366/7 |

OTHER PUBLICATIONS

Written Opinion of the International Searching Authority and International Search Report (Forms PCT/ISA/237 and PCT/ISA/210); dated Sep. 2, 2016 in corresponding International Patent Application No. PCT/US 16/35636 (19 pages).
http://www.atlasindustries.in/doubledrumasphaltplant.html
"Counterflow Asphalt Drum Mix Plant" (Atlas Industries) May 2, 2015.

(Continued)

*Primary Examiner* — Mark Halpern
(74) *Attorney, Agent, or Firm* — Staas & Halsey LLP

(57) ABSTRACT

A highly portable asphalt plant of substantial size and product manufacturing capacity carries the system components on the confines of two transportable vehicles. The two vehicles are arranged in a fashion whereby vehicle one is connected to vehicle two in an inline continuous fashion. Vehicle two contains an integrated inertial dust separator baghouse design and provides for the receiving of the rotary dryer drum mixer directly and without the use, of interconnecting ductwork.

19 Claims, 9 Drawing Sheets

Transport mode Load 1

Transport mode Load 2

(56) References Cited

OTHER PUBLICATIONS http://web.archive.org/web/20150507163618/http://www.atlasindustries.in/downloads.html "Portable Asphalt Drum Mix Plant" (Atlas Industries) May 2, 2015.
http://www.stansteel.com/conveyors.asp "Conveyors" (Stansteel) Jun. 18, 2013.

* cited by examiner

Transport mode Load 1

Transport mode Load 2

Load 2 Silo Erection

Load 2 Silo Erection

Fig. 5: Dust Collection and Return

Load 1 and 2 Installation

Fig. 7: Collector belt weigh scale device

Load 1 and 2 Mate

Plant Operational

HIGHLY PORTABLE ASPHALT PLANT

CROSS-REFERENCE TO RELATED APPLICATIONS

This application is based upon and claims the benefit of priority of U.S. Provisional Application Ser. No. 62/170,786, filed Jun. 4, 2015, the entire contents of which are incorporated herein by reference.

BACKGROUND

1. Field

This invention relates to the hot mix asphalt plant used to manufacture asphaltic mixes to pave highways.

2. Description of the Related Art

The components of the state of the art hot mix asphalt plant combine process methods to heat and dry aggregates, add coarse and fine aggregate dust particles and mix them with asphalt. The raw material virgin aggregates release dust particles as they are heated and dried that must be collected using mechanical separation for the coarse dust particles along with fine dust collection using fabric filters or baghouses to eliminate air borne particulate from entering the atmosphere. Asphalt plants use rotary dryers to tumble the aggregates in the presence of heat to remove the moisture and heat them to the process temperature.

Drying aggregates with the rotary dryer involves a physical separation process designed for the purpose to remove the liquid phase or moisture using thermal energy. The liquid in this case is water that is liberated by the process of vaporization leaving a solid or aggregates with a trace of residual moisture. The dryer is a direct heat dryer as heat transfer for drying is accomplished by direct contact between the wet solid aggregate with hot gases from a combustion burner. This invention describes the dryer as a rotating cylindrical shell, slightly inclined to the horizontal with the heating medium flowing in a countercurrent direction to the flow of aggregates through the dryer. The dryer is equipped with flights or lifters on the interior for lifting and moving the wet aggregates through the hot gas stream as they pass through the cylinder.

As the gases pass through the dryer the aggregates become hot and dry thus liberating aggregate dusts that cling to the aggregates. Some aggregates liberate dust as they are tumbled through the rotary dryer. The dryer operates under a suction pressure as the dust particles are pulled through the dryer and into the coarse particle mechanical dust separation devices and finally into the fabric filters for dust collection. Those dust particles must pass from the rotary dryer to the dust collection devices generally using ductwork or large round pipes or rectangular ducts to move the moisture, products of combustion and dust to the dust collection devices. This industrial size external ductwork usually requires the use of a large lifting crane to assemble the ductwork from the rotary dryer to the dust collection devices and filter house needed to collect the hot dry aggregate particles. Moving the asphalt plant from one location to another becomes cumbersome as lifting equipment is needed to assemble and disassemble the plant rotary dryer from the dust collection equipment.

Making asphaltic mixes requires a recipe using a combination of sand and varying sizes of aggregates. Multiple bins are needed to contain the sand and aggregates. The bins are filled using construction bucket loading tractors from the site stored aggregates piles.

The aggregate bins are each fitted with an underlying variable speed belt feeder that proportions the needed flow of raw material to combine the hot mix recipe.

The raw aggregates are generally conveyed with a belt collection conveyor to a large vibrating screen to insure debris or oversize materials are eliminated from the flow of aggregates to insure a smooth road surface. A vibrating screen device of the size needed on the asphalt plant generally must be conveyed as a separate unit and mounted to a large wheeled trailer assembly in order for it to be conveyed for the portable plant. Bins of this size and capacity normally require a large individual wheeled trailer assembly as they are moved as a separate component of the portable asphalt plant. The movement of aggregates from the aggregate bins and oversize vibrating screen requires the use of a long portable conveyor belt assembly to move the aggregates to the rotary dryer for processing. These portable conveyors are fitted with truck axles and wheels as they are moved along with the portable asphalt plant.

The dust particle size separation and collection equipment needed on the portable plant is generally conveyed as a separate component with truck axles and wheels that also must be positioned on the plant site to mount the large connecting duct pieces between the rotary dryer and dust separation equipment. The large portable rotary dryers as well are conveyed as a separate component with truck axles. Ductwork connection and feed conveying plant components must be connected to the rotary dryer once it is in place at the portable plant site.

Once the hot mix asphalt is produced it must be conveyed away from the rotary dryer, stored and weighed and then transferred to a dump truck to be carried to the road paving site. Each of these devices must be made portable and carried along with the other plant components as a separate piece of equipment with truck axles as trailer assemblies.

Each time a portable hot mix asphalt plant is moved, each site must be graded, leveled and compacted to insure the proper soil surface conditions exist to allow the equipment to be assembled and parked for alignment and safety. As described, the portable hot mix asphalt plant can easily contain ten individual plant components. Transporting and preparing the site represents time taken away from actual plant production; the cost to prepare the site, grading for each piece of equipment and the cost of additional site preparation materials such as soil and aggregates to prepare and level the site.

SUMMARY

As can be derived from the aforementioned description of a typical portable hot mix plant, there is a significant advantage for a highly portable plant that can be manufactured with fewer major components and can be erected and operational faster than a typical plant. Such a plant would be designed so as to not require lifting cranes to erect the plant; require fewer transport truck loads; have a smaller geographical footprint; and can be quickly erected and assembled thus saving time, energy and financial burden.

In one aspect, a highly portable asphalt plant of substantial size and product manufacturing capacity carries the system components on the confines of two transportable vehicles. The two vehicles are arranged in a fashion whereby vehicle one is connected to vehicle two in an inline continuous fashion. Vehicle two contains an integrated inertial dust separator baghouse design and provides for the receiving of the rotary dryer drum mixer directly and without the use, of interconnecting ductwork.

In another aspect, a transportable hot mix asphalt plant apparatus includes a first vehicle having an aggregate collector conveyor, at least one aggregate storage bin disposed above the aggregate collector conveyor, at least one aggregate storage bin equipped with a variable speed aggregate feeder belt discharging onto a vibrating screen, the aggregate collector conveyor having a collector belt weigh scale disposed at an output end, the output end discharging onto an aggregate collector belt extension, and a second vehicle having a counter-flow aggregate rotary dryer and mixer, the counterflow aggregate rotary dryer and mixer receiving aggregate from a discharge end of the aggregate collector belt extension, a hot mix asphalt elevating drag slat conveyor to convey asphalt mix to a storage hopper, a self-erecting frame for the hot mix asphalt elevating drag slat conveyor, and a support stand for the storage hopper.

In another aspect, a transportable hot mix asphalt plant carries a plurality of major components on a first and a second vehicles for transport within guide lines of typical road transportation limits.

In another aspect, a transportable hot mix asphalt plant apparatus assembles a first and a second vehicles at a job site without a need of inter-connecting ductwork between a rotary dryer and a dust collection device.

In another aspect, a transportable hot mix asphalt plant apparatus erects an apparatus in a field without a need of auxiliary lifting devices or lifting cranes.

In another aspect, a transportable hot mix asphalt plant apparatus connects a rotary dryer to an inlet of a primary collector, and connects a primary collector directly to a filter baghouse without inter-connecting ductwork.

In another aspect, a transportable hot mix asphalt plant allows dust laden exhaust gases from a rotary dryer to be directed to an inlet of a primary collector without inter-connecting ductwork.

In another aspect, a transportable hot mix asphalt plant apparatus includes a floating seal assembly located on a rotary dryer for direct connection to a primary collection box on a baghouse without external inter-connecting ductwork.

In another aspect, a transportable hot mix asphalt plant apparatus includes a small dynamic in-motion scalping screen disposed on a at least one aggregate storage bin.

In another aspect, a transportable hot mix asphalt plant apparatus includes a plurality of aggregate storage bins, each of the plurality of aggregate storage bins having a small dynamic in-motion scalping screen in place of one large dynamic scalping screen for a plurality of aggregate storage bins.

In another aspect, a transportable hot mix asphalt plant apparatus includes a unique counter-flow baghouse design that does not require a use of an air compressor to pulse clean dust filter bags.

In another aspect, a transportable hot mix asphalt plant apparatus includes a unique portable counter-flow baghouse that incorporates an integral coarse dust inertial separator—primary dust collector.

In another aspect, a transportable hot mix asphalt plant apparatus includes a combination portable counter-flow baghouse—inertial dust collector that includes screw augers to remove dust from a baghouse and a cross auger assembly to collect a dust from an inertial dust collector.

In another aspect, a transportable hot mix asphalt plant apparatus includes a unique portable baghouse and inertial dust collector assembly that incorporates a collecting dust system of screw augers for fine and coarse dust collection in one assembly.

In another aspect, a transportable hot mix asphalt plant apparatus includes a unique portable baghouse dust collector design assembly that provides for acceptance of a rotary dryer directly to an inertial dust collector assembly.

In another aspect, a transportable hot mix asphalt plant apparatus includes a unique portable baghouse and inertial dust collector assembly that includes a complete dust removal system to collect both fine and coarse dust particles.

In another aspect, a transportable hot mix asphalt plant apparatus includes a combination portable counter-flow baghouse—inertial dust collector assembly that includes a pneumatic dust transport system from a baghouse to a mixing zone of a counter-flow aggregate rotary dryer and mixer in which hot liquid asphalt is combined with aggregates.

In another aspect, a transportable hot mix asphalt plant apparatus includes a portable counter-flow baghouse with a multiple pocket, elliptical design filter for increased filter media surface area in a smaller geographical footprint.

In another aspect, a transportable hot mix asphalt plant apparatus includes a unitized transportable vehicle assembly that contains at least one aggregate storage bin, conveyor belt feeders, scalping screen for each feeder, aggregate collector conveyor, collector belt weigh scale, aggregate collector belt extension to move aggregates to a rotary dryer, coarse dust primary collector, fine dust baghouse filter, baghouse exhauster fan, exhauster fan damper, system exhaust stack, baghouse dust hopper screw augers, dust collection cross auger, wheeled truck axles for portability, and trailer connection pin to connect transport truck tractor with unitary frame design for transport.

In another aspect, a unitized transportable vehicle assembly contains a counter-flow aggregate rotary dryer and mixer, a hot mix asphalt elevating drag slat conveyor, a self-erecting frame, a support stand for a storage hopper, an asphalt injection system, a combustion burner, rotary dryer drive components, wheeled truck axles for portability, and a trailer connection pin to connect transport truck tractor with a unitary frame design for transport.

The above and other features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
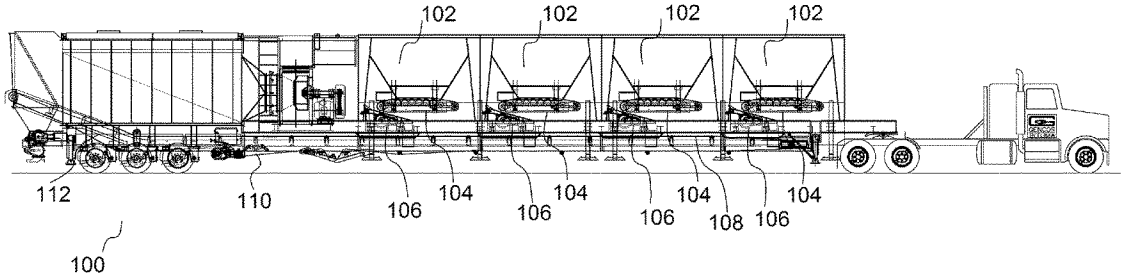
FIG. 1 shows a first vehicle in transport mode according to an embodiment.

In FIG. 1 is shown a first vehicle 100 in transport mode according to an embodiment. The first vehicle 100 includes up to four virgin aggregate feed bins 102 of substantial size that can be charged with virgin aggregates using large wheeled loader tractors. Each of the aggregate feed bins 102 is equipped with a variable speed aggregate feeder belt 104 used to accurately control the flow of varying sizes of aggregates and sand to manufacture hot mix asphalt of any specification.

Each of the aggregate feeder belts 104 discharges onto a vibrating screen 106 used to screen out any over size aggregates, rocks or debris. The debris is directed over the side of the feed assembly away from the equipment. The vibrating screens 106 are sized to accommodate the flow of aggregates from only one feed bin feeder allowing the use of a smaller size screening unit.

The screened aggregates are then directed onto a collection conveyor belt 108. The collection conveyor belt 108 moves under each of the aggregate feed bins 102 collecting the portions of aggregate from each feeder. As the collection conveyor belt 108 progresses forward, it passes over a collector belt weigh scale device 110 that develops an electrical output signal used by the control system to measure the total flow of aggregates across the collector belt weigh scale device 110 to accurately weigh the plurality of aggregates as they progress toward the rotary dryer 202 (shown in FIG. 2). To save space the collection conveyor belt 108 progresses under the primary and secondary dust collection devices or baghouse.

Figure 2:
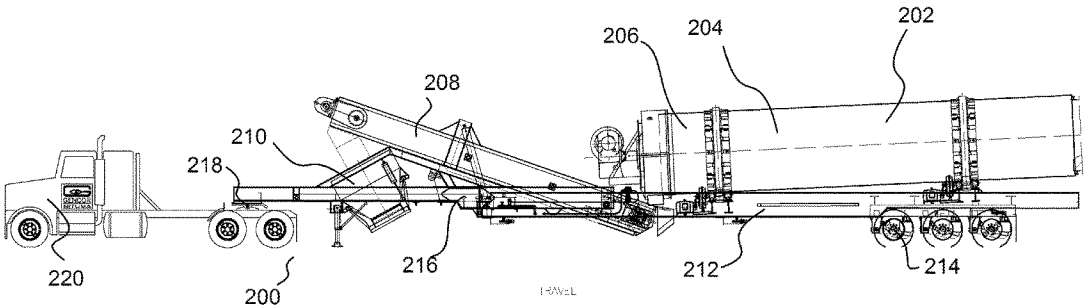
FIG. 2 shows a second vehicle in transport mode according to the embodiment.
Figure 5:
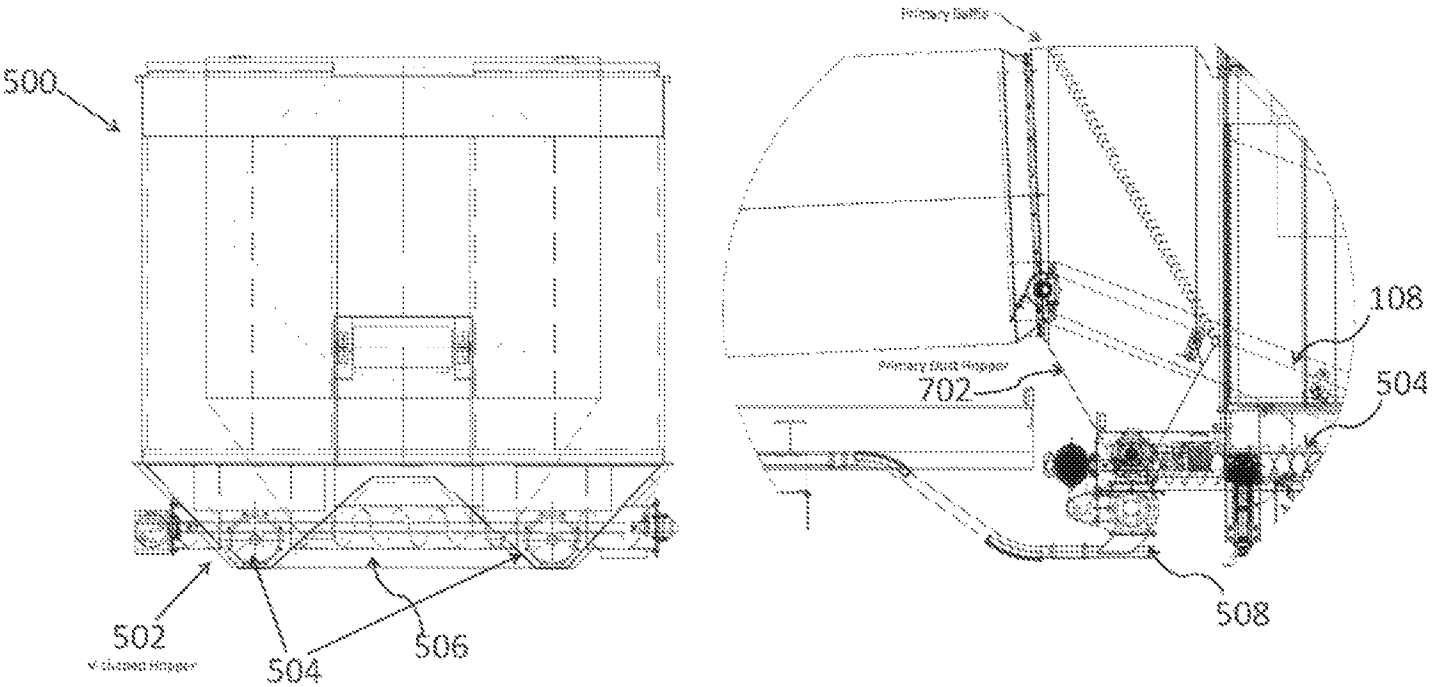
FIG. 5 shows a baghouse for the second vehicle.

In FIG. 5 is shown a baghouse 500 according to an embodiment of the invention. The collection conveyor belt 108 is enclosed into a rectangular housing as it is elevated in height and passes up and through the baghouse 500 and primary collector. Aggregates carried on the belt are deposited into the rotary dryer 202 located on the second vehicle 200, which is shown in FIG. 2. The dust laden gases exiting the rotary dryer 202 on the second vehicle 200 enter the primary collector where the heavier dust particles are separated as the gases continue and move into the baghouse where the finest of aggregate particulate are collected.

The floor of the baghouse 500 is separated into two dust collection, v-shaped hoppers 502 on the left and right side. Each of the hopper sections 502 encloses a screw auger conveyor 504 to move the dust from one end of the baghouse 500 forward and into a cross auger assembly 506 perpendicular to the baghouse hopper augers 504. The cross auger assembly 506 then carries all of the coarse and fine dust particles to one side of the baghouse 500 and discharges the dust to a rotary airlock feeder 508. The rotary air lock feeder 508 stops air and dust back flow from re-entering the baghouse dust augers, and allows the dust to be blown to the end of the rotary dryer 202 on the second vehicle 200 into the mixing zone of the drum mixer dryer. This rotary airlock feeder 508 transfers the dust to an air eductor device on the dust line that is under positive air pressure from a motor driven dust blower.

Figure 8:
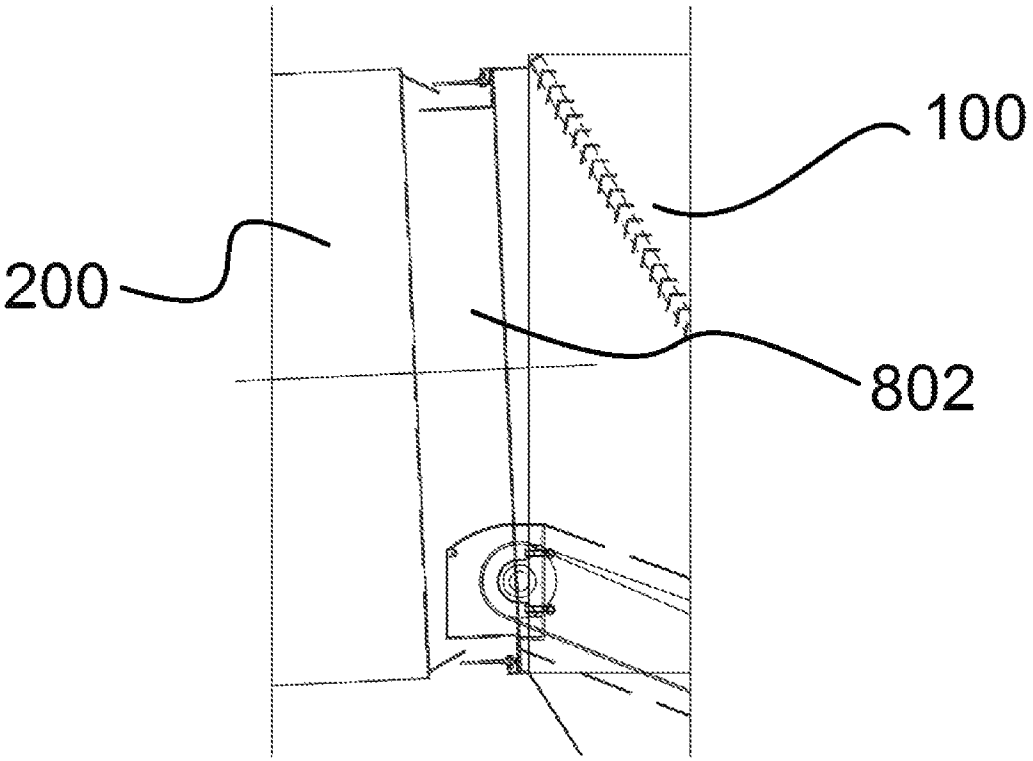
FIG. 8 shows the first vehicle mated to the second vehicle.

In FIG. 8 is shown a floating seal assembly 802 located on the rotary dryer for direct connection to a primary collection box on a baghouse without interconnecting ductwork. This floating seal assembly 802 allows the dust laden exhaust gases from the rotary dryer to be directed to the air Inlet of the primary collector. The floating seal assembly 802 prevents dust laden gases from escaping to the atmosphere.

The counter-flow dust collection baghouse 500 operates at low differential air pressure across the body of the baghouse 500. Lower differential air pressure requires less fan horsepower which is the advantage to this operational design. The counter-flow self-cleaning baghouse 500 does not use compressed air to pulse clean the bag filter elements. Therefore, an air compressor is not required to supply the motive force to clean the filter bags which is an additional advantage in using the counter flow baghouse design. In addition, an air compressor is not required for the plant components nor is electrical power or air piping. This is an additional advantage to the counter-flow baghouse.

In total, the first vehicle 100 contains the aggregate storage bins 102, conveyor belt feeders, scalping screen for each feeder, aggregate collector conveyor 108, collector belt weigh scale device 110, aggregate collector belt extension to move the aggregates to the rotary dryer 202, coarse dust primary collector, fine dust baghouse filter collector, baghouse exhauster fan, automatic exhauster fan damper, system exhaust stack, (2) baghouse dust hopper screw augers, dust collection cross auger, wheeled truck axles for portability, and trailer connection pin to connect transport truck tractor with unitary frame design.

In FIG. 2 is shown a second vehicle 200 in transport mode according to an embodiment. The rotary dryer 202 is located on the second vehicle 200. Aggregates from the first vehicle 100 are fed into the feed end of the rotary dryer 202 from the collection conveyor belt 108 elevating extension 112 (shown in FIG. 1). The aggregates start at the dryer exhaust gas end of the rotary dryer 202 and slowly move forward into the counter-flow dryer drum 204. The counter-flow dryer drum 204 is positioned at a downward angle to allow the cascading aggregates inside the rotary dryer 202 to advance toward the discharge end of the rotary dryer 202 as it rotates. Once the aggregates are hot and dry they advance into the mixing portion of the drum mixer 206 where dust, additives and liquid hot asphalt are injected to formulate the hot mix asphalt.

The rotary dryer 202 is heated using a combustion burner that mounts inside the support structure in the mixing portion of the counter-flow dryer drum 204. The combustion burner supplies the heat necessary to the aggregates in the rotary dryer 202. The firing end of the burner extends into the discharge end of the rotary dryer 202 beyond the mix section so as not to overheat the aggregates and liquid asphalt as they are mixed together in the mixing zone of the dryer prior to being discharged as final product.

The final hot mix asphalt flows from the discharge of the rotary dryer 202 into a drag slat elevating conveyor 208. The final hot mix asphalt moves to an elevation to allow it to flow into a storage hopper 210. A dump truck is positioned under the storage hopper 210 and the final hot mix asphalt is dispensed into the dump truck. The truck moves away and the process continues as another truck moves into position to receive hot mix asphalt from the hopper above.

The trailer 212 under the rotary dryer 202 is equipped with truck axles 214 for transport by a tractor trailer. The drag slat elevating conveyor 208 is mounted on a pivot pin connection that allows the unit to be elevated when the plant is set for operation. As the plant is prepared for moving, the drag slat elevating conveyor 208 is lowered. In the transport position, the drag slat elevating conveyor 208 is reduced in height to meet typical road transport height requirements. The drag slat elevating conveyor 208 lowers on its pivot connection to travel with the second vehicle 200 fully assembled and is not removed for transport. The storage hopper 210 is part of the drag slat elevating conveyor 208 assembly which folds over to allow transport on the same vehicle assembly.

In total, the second vehicle 200 contains the counter-flow aggregate rotary dryer 202 and mixer combination, asphalt injection system, combustion burner, rotary dryer 202 drive components, wheeled truck axles 214 for portability, trailer connection pin 218 to connect the transport truck tractor 220 with unitary frame, self-erecting trailer frame 216 to be used in the transport position, hot mix asphalt drag slat elevating conveyor 208 to convey asphalt mix to the storage hopper for delivery into trucks and the support stand for the storage hopper. All of these devices are stored on the trailer assembly in the transport position and are transported as a single unit.

Figure 3:
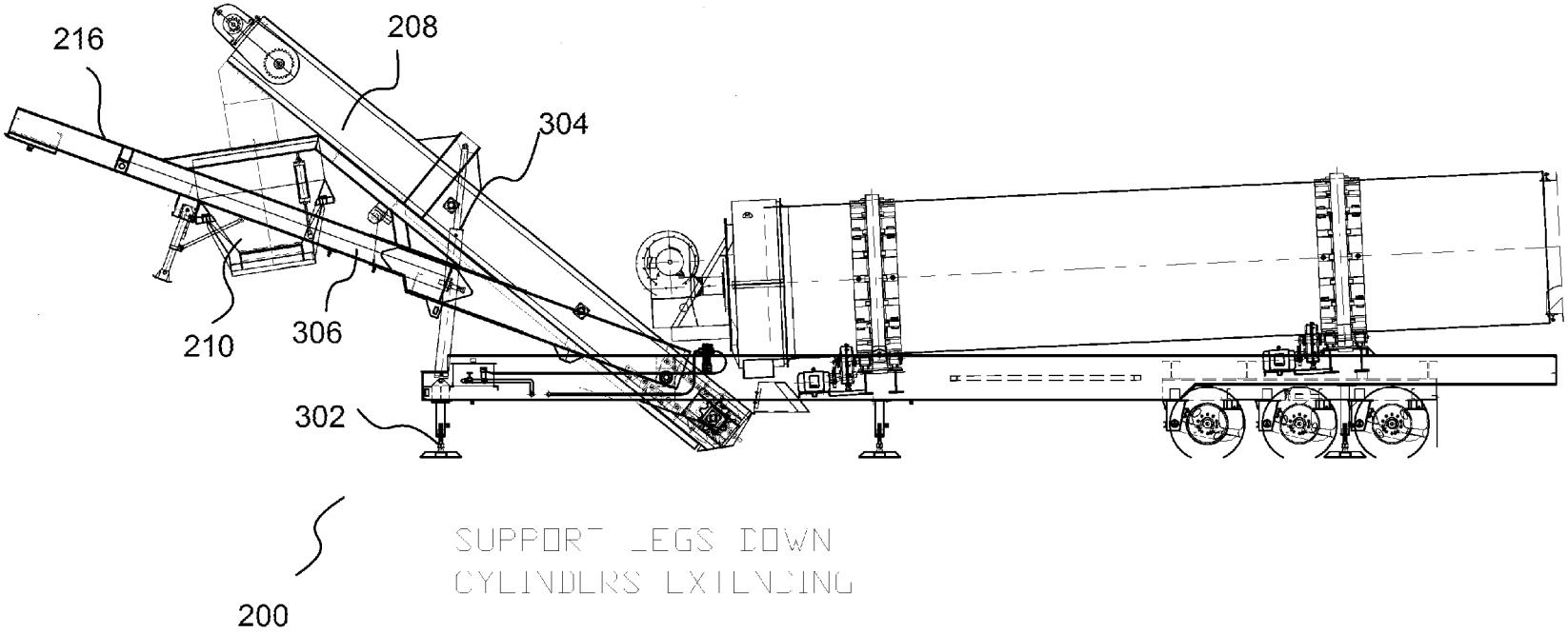
FIG. 3 shows a silo of the second vehicle being erected.

In FIG. 3 is shown the silo of the second vehicle 200 being erected. The trailer support legs 302 are down, while the cylinders 304 that will raise the drag slat elevating conveyor 208, the storage hopper 210, and the vertical self-erecting legs 216 are shown being extended in FIG. 3. The support legs 306 are still stowed.

Figure 4:
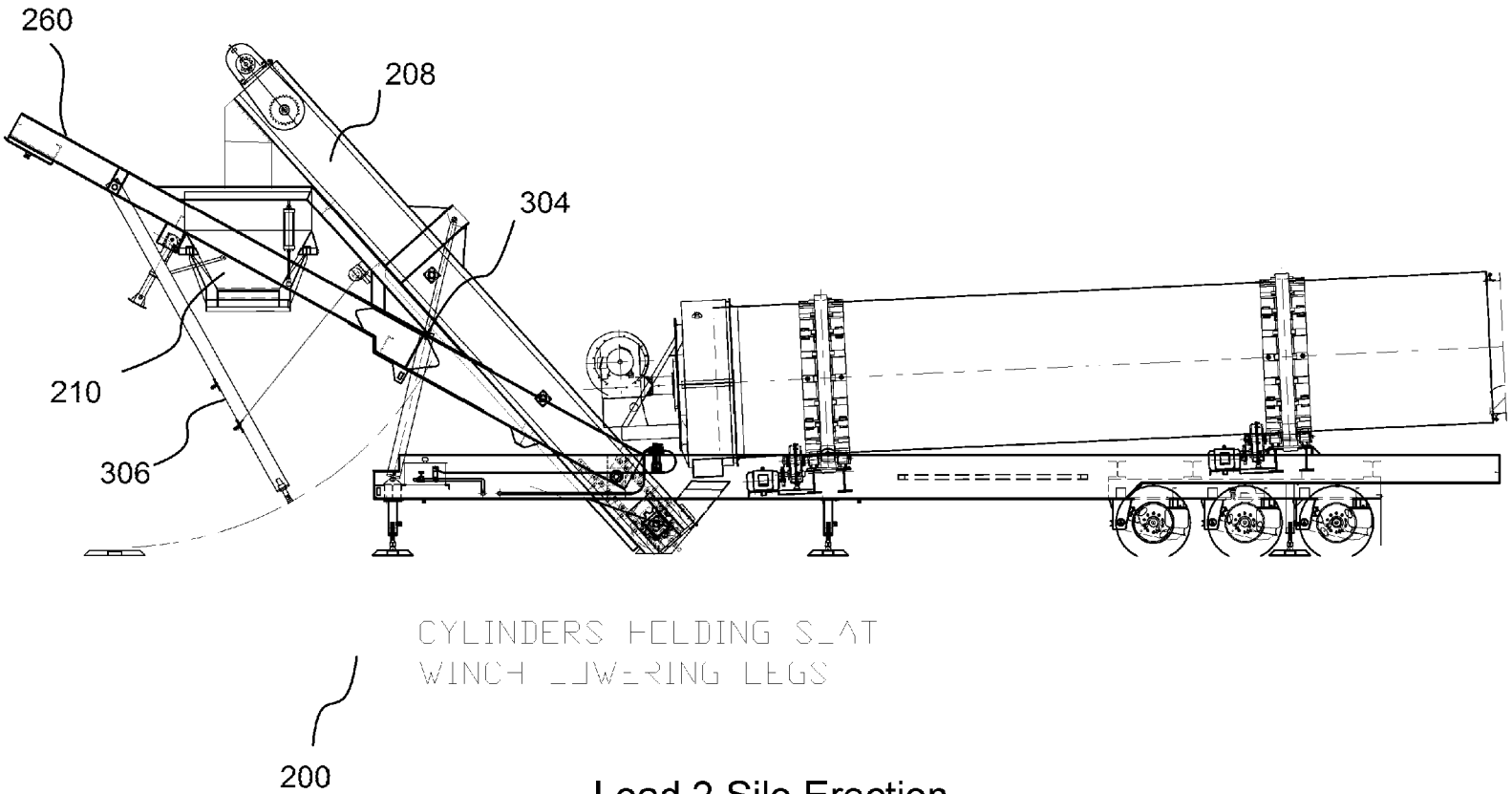
FIG. 4 shows the silo of the second vehicle being erected.

In FIG. 4 is shown the silo of the second vehicle 200 being erected. The cylinders 304 that will raise the drag slat elevating conveyor 208, the storage hopper 210, and the vertical self-erecting legs 216 are shown being extended in FIG. 4. The support legs 306 are swinging into position.

Figure 6:
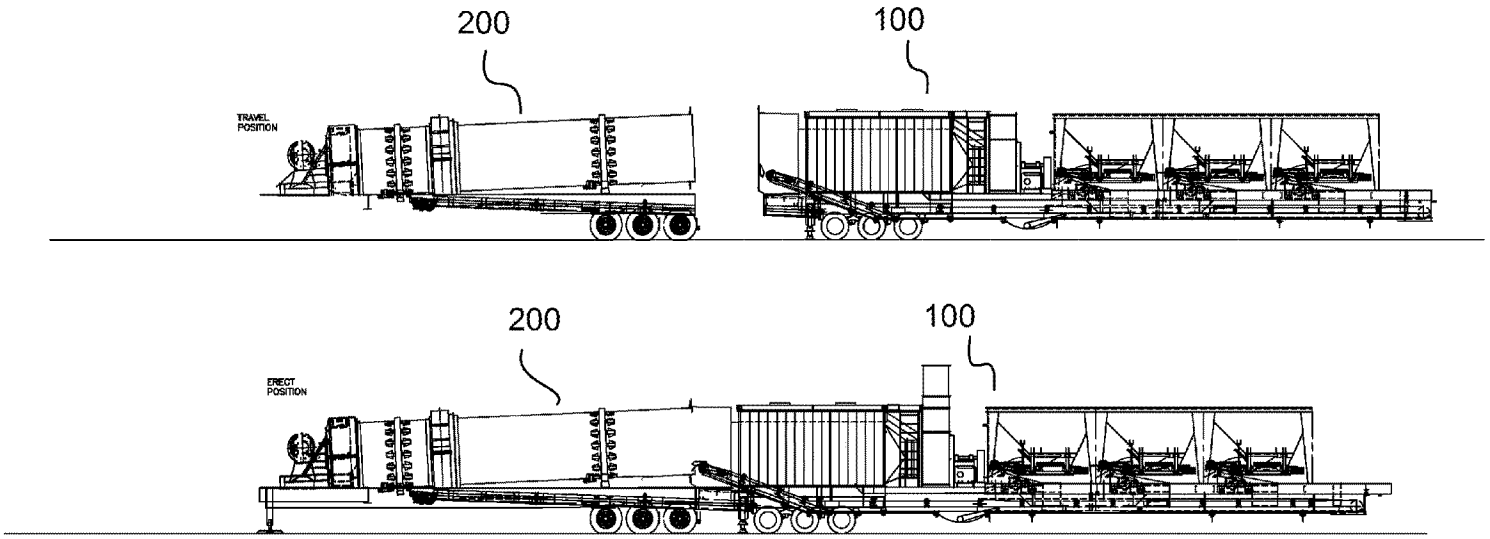
FIG. 6 shows the first and the second vehicles in an installed condition.
Figure 9:
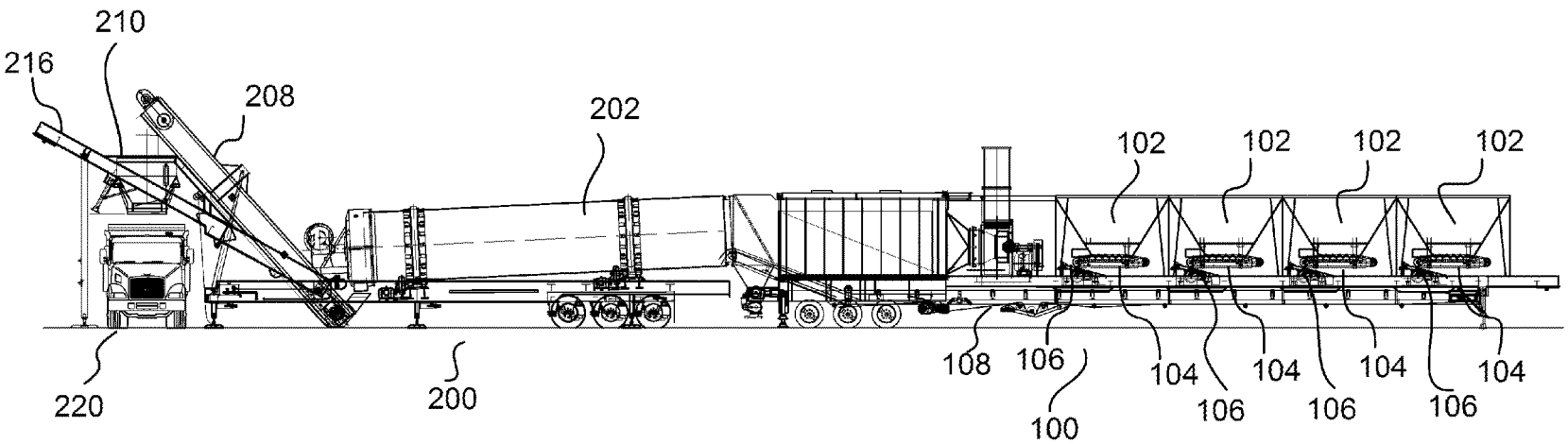
FIG. 9 shows the first vehicle and the second vehicle in operation.

The major plant components are contained within two main trailer vehicles, as shown in FIG. 9. Both vehicles 100 and 200 are backed into each other using a transport truck tractor, as shown in FIG. 6. The plant operates as follows:

Each of the aggregate storage bins 102 are charged or filled with aggregate needed to meet the needs of the hot mix asphalt design.

The conveyor belt feeders under each of the bins 102 is electrically turned on. The speed of the feeder belts 104 are varied so as to control the needed percentage of each raw material component required for the hot mix asphalt design.

Each of the conveyor belt feeders discharges the aggregates over each of the small, electrically operated vibrating scalping screens 106 located at the end of the feeder belts 104. Any oversize aggregates or debris is discarded off to the side to insure the integrity of the raw material mix design.

The select aggregates discharge onto a centrally located belt conveyor or collection conveyor belt 108 that is in motion under the aggregate bins 102 and feeders. The collection conveyor belt 108 travels under the aggregate bins 102 and longitudinally conveys the aggregates under and through the baghouse and up and into the rotary dryer 202.

Figure 7:
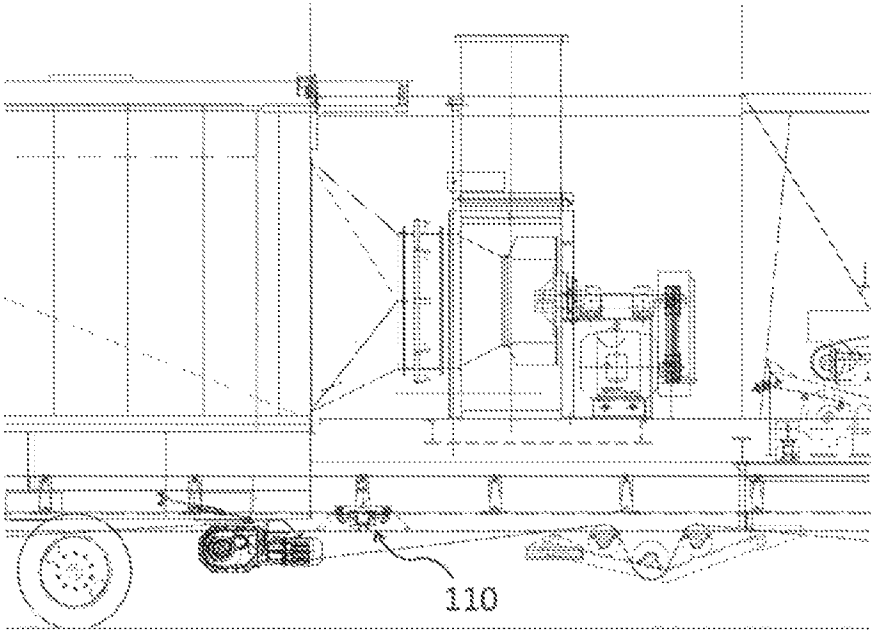
FIG. 7 shows the collector belt weigh scale device.

A conveyor belt weigh scale device 110 is mounted on the collection conveyor belt 108 downstream of the aggregate bins 102 to electrically measure the flow of aggregates on the collection conveyor belt 108, as shown in FIG. 7.

The flow of exhaust gases from the rotary dryer 202 pass through the primary coarse dust collector prior to flowing into the fine particle baghouse filter collection assembly. Those coarse dust particles fall into a hopper and are directed to the baghouse dust collection auger.

The fine particle collection baghouse collects and disperses internally the dust into two hopper mounted dust screw auger assemblies driven by electric motors. The screw augers convey the dust from the baghouse to the dust cross auger assembly mounted perpendicular to the back side of the baghouse.

Coarse dust from the primary collector and fine dust from the baghouse is collected onto the baghouse cross auger. Dust is then delivered to a rotary valve feeder and airlock to convey the dust under negative suction pressure from the baghouse. The rotary valve directs the dust to an eductor assembly attached to a pressure blower. The pressure pneumatically forces the dust through a dust pipe and directs the dust into the mixing section of the rotary dryer 202. The dust is combined with liquid asphalt and aggregates to produce the end product hot mix asphalt design.

The rotary dryer 202 located on the second vehicle 200 receives the raw aggregates from the aggregate collection conveyor on the first vehicle 100. Aggregates pass from the feed end of the dryer and are heated and dried to remove internal moisture. Next, the aggregates are mixed with liquid asphalt and dust conveyed from the baghouse to produce the final hot mix asphalt design.

The hot mix asphalt is directed from the discharge end of the rotary drum mixer into a drag slat elevating conveyor 208. The hot mix asphalt is conveyed to an elevation above the hot storage hopper 210. The drag slat elevating conveyor 208 is driven by an electric motor continually moving hot mix asphalt in incremental amounts between the slats of the conveyor chain. The asphalt falls off the discharge end of the conveyor into the storage hopper 210.

The interim storage hopper 210 is held in place by the drag slat elevating conveyor 208 of one side and vertical self-erecting legs 216 on the opposite side of the assembly to support the weight of the hopper 210 and hot mix asphalt delivered into the hopper 210.

The foregoing has described the principles, embodiments, and modes of operation of the present invention. However, the invention should not be construed as being limited to the particular embodiments described above, as they should be regarded as being illustrative and not restrictive. It should be appreciated that variations may be made in those embodiments by those skilled in the art without departing from the scope of the present invention.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that the invention may be practiced otherwise than as specifically described herein.

What is claimed is:

1. A transportable hot mix asphalt plant apparatus, comprising:

a first vehicle having an aggregate collector conveyor, at least one aggregate storage bin disposed above the aggregate collector conveyor, the at least one aggregate storage bin equipped with a variable speed aggregate feeder belt discharging onto a vibrating screen, the aggregate collector conveyor having a collector belt weigh scale disposed at an output end, the output end discharging onto an aggregate collector belt extension; and a second vehicle having a counter-flow aggregate rotary dryer and mixer, the counterflow aggregate rotary dryer and mixer receiving aggregate from a discharge end of the aggregate collector belt extension, a hot mix asphalt elevating drag slat conveyor to convey asphalt mix to a storage hopper, a self-erecting frame for the hot mix asphalt elevating drag slat conveyor, and a support stand for the storage hopper.

2. The transportable hot mix asphalt plant apparatus of claim 1, further comprising carrying a plurality of major components on the first and the second vehicles for transport within the guide lines of typical road transportation limits.

3. The transportable hot mix asphalt plant apparatus of claim 1, further comprising assembling the first and the second vehicles at a job site without a need of inter-connecting ductwork between the rotary dryer and a dust collection device.

4. The transportable hot mix asphalt plant apparatus of claim 1, further comprising erecting the apparatus in a field without a need of auxiliary lifting devices or lifting cranes.

5. The transportable hot mix asphalt plant apparatus of claim 1, further comprising connecting the rotary dryer to an inlet of a primary collector; and connecting the primary collector directly to a filter baghouse without inter-connecting ductwork.

6. The transportable hot mix asphalt plant apparatus of claim 1, further comprising allowing dust laden exhaust gases from the rotary dryer to be directed to an inlet of a primary collector without inter-connecting ductwork.

7. The transportable hot mix asphalt plant apparatus of claim 1, further comprising a floating seal assembly located on the rotary dryer for direct connection to a primary collection box on a baghouse without external inter-connecting ductwork.

8. The transportable hot mix asphalt plant apparatus of claim 1, further comprising a small dynamic in-motion scalping screen disposed on the at least one aggregate storage bin.

9. The transportable hot mix asphalt plant apparatus of claim 1, further comprising a plurality of aggregate storage bins, each of the plurality of aggregate storage bins having a small dynamic in-motion scalping screen in place of one large dynamic scalping screen for the plurality of aggregate storage bins.

10. The transportable hot mix asphalt plant apparatus of claim 1, further comprising a unique counter-flow baghouse design that does not require the use of an air compressor to pulse clean dust filter bags.

11. The transportable hot mix asphalt plant apparatus of claim 1, further comprising a unique portable counter-flow baghouse that incorporates an integral coarse dust inertial separator—primary dust collector.

12. The transportable hot mix asphalt plant apparatus of claim 1, further comprising a combination portable counter-flow baghouse—inertial dust collector that includes screw augers to remove dust from the baghouse and a cross auger assembly to collect the dust from the inertial dust collector.

13. The transportable hot mix asphalt plant apparatus of claim 1, further comprising a unique portable baghouse and inertial dust collector assembly that incorporates a collecting dust system of screw augers for fine and coarse dust collection in one assembly.

14. The transportable hot mix asphalt plant apparatus of claim 1, further comprising a unique portable baghouse dust collector design assembly that provides for acceptance of a rotary dryer directly to an inertial dust collector assembly.

15. The transportable hot mix asphalt plant apparatus of claim 1, further comprising a unique portable baghouse and inertial dust collector assembly that includes a complete dust removal system to collect both fine and coarse dust particles.

16. The transportable hot mix asphalt plant apparatus of claim 1, further comprising a combination portable counter-flow baghouse—inertial dust collector assembly that includes a pneumatic dust transport system from a baghouse to a mixing zone of the counter-flow aggregate rotary dryer and mixer in which hot liquid asphalt is combined with aggregates.

17. The transportable hot mix asphalt plant apparatus of claim 1, further comprising a portable counter-flow baghouse with a multiple pocket, elliptical design filter for increased filter media surface area in a smaller geographical footprint.

18. The transportable hot mix asphalt plant apparatus of claim 1, further comprising a unitized transportable vehicle assembly that contains the at least one aggregate storage bin, conveyor belt feeders, scalping screen for each feeder, aggregate collector conveyor, collector belt weigh scale, aggregate collector belt extension to move the aggregates to the rotary dryer, coarse dust primary collector, fine dust baghouse filter, baghouse exhauster fan, exhauster fan damper, system exhaust stack, baghouse dust hopper screw augers, dust collection cross auger, wheeled truck axles for portability, and trailer connection pin to connect transport truck tractor with unitary frame design for transport.

19. The transportable hot mix asphalt plant apparatus of claim 1, further comprising a unitized transportable vehicle assembly that contains the counter-flow aggregate rotary dryer and mixer, the hot mix asphalt elevating drag slat conveyor, the self-erecting frame the support stand for the storage hopper, an asphalt injection system, a combustion burner, rotary dryer drive components, wheeled truck axles for portability, and a trailer connection pin to connect transport truck tractor with a unitary frame design for transport.

* * * * *